US005816884A

United States Patent [19]

Chang

[11] Patent Number: 5,816,884

[45] Date of Patent: Oct. 6, 1998

[54] MUSIC BOX HAVING A WATER PUMP STRUCTURE

[75] Inventor: Po-Shin Chang, Taipei, Taiwan

[73] Assignee: Victradco Ltd., Taipei, Taiwan

[21] Appl. No.: 866,019

[22] Filed: May 30, 1997

[51] Int. Cl.[6] ..... A63H 23/00

[52] U.S. Cl. ..... 446/267; 446/404; 40/406; 40/410

[58] Field of Search ..... 446/81, 191, 267, 446/404; 40/406, 407, 409, 410

[56] References Cited

U.S. PATENT DOCUMENTS

| | | | |
|---|---|---|---|
| 3,600,847 | 8/1971 | Lakin et al. . | |
| 4,641,445 | 2/1987 | Rossi | 40/410 |
| 4,817,311 | 4/1989 | Ong S. T. | 40/410 |
| 5,313,727 | 5/1994 | Murray, Jr. | 40/410 |
| 5,348,508 | 9/1994 | Garfinkel | 40/407 |
| 5,396,723 | 3/1995 | Liu | 40/406 |
| 5,491,916 | 2/1996 | Ingram et al. | 40/406 |
| 5,666,750 | 9/1997 | Segan et al. | 446/267 |

*Primary Examiner*—Robert A. Hafer
*Assistant Examiner*—Jeffrey D. Carlson
*Attorney, Agent, or Firm*—Browdy & Neimark

[57] ABSTRACT

A music box having a water pump structure, especially to a music box in combination with a water pump, includes a music box, a water pump, and a regulating valve wherein the music box is provided with a linking member by which the water pump is connected with the music box. The linking member is associated with a water pressure plate of the water pump and the movement of the linking member triggered off by the music box will activate the water pressure plate to move back and forth. The to-and-fro movement of the water pressure plate will in turn generate a pressure, forcing water to circulate in and out of two main bodies of the water pump. In addition, the regulating valve having one-dimensional water influx and discharging valves is adapted to regulate the water circulation in one direction. Ornamental articles such as a crystal ball can be further attached to the present invention whereby music is given sweetly out by the music box while the water current is lively circulated in and out of the water pump simultaneously.

3 Claims, 4 Drawing Sheets

MUSIC BOX HAVING A WATER PUMP STRUCTURE

BACKGROUND OF THE PRESENT INVENTION

The present invention relates to a music box having a water pump structure, especially to a music box in combination with a water pump. The music box is provided with a rotary disc to which a linking member is engaged at one end. The other end of the linking member is attached to the water pump so that the movement of the linking member triggered off by the music box will activate the mechanism of the water pump, forcing water to be circulated in and out of the water pump. In addition, a regulating valve is adapted to be associated with the water pump, which having one-dimensional water influx and discharging valves can regulate the circulation of water in one direction. Ornamental articles such as a crystal ball can be further attached to the present invention whereby music is sweetly given out by the music box while the water current is lively circulated in and out of the water pump simultaneously.

A conventional music box is simply constructed, including a rolling wheel disposed with protruding dots thereon and a comb-shaped resilient plate whereby music is given out by the motion of the rolling wheel triggering off the comb-shaped resilient plate via the protruding dots thereof. However, it is quite dull and has completely lost attraction to the consumers. It is therefore necessary to provide a new and lively music box structure to boost up the interests of the consumers.

SUMMARY OF THE PRESENT INVENTION

It is, therefore, the primary object of the present invention to provide a music box having a water pump structure, especially to a music box structure in combination with a water pump wherein the music box is provided with a linking member to be attached to the water pump at the other end so that the movement of the linking member will activate the mechanism of the water pump. In addition, a regulating valve is adapted to be associated with the water pump so as to regulate water to circulate in and out of the water pump in one direction. Ornamental articles such as a crystal ball can be combined with the present invention whereby the music is sweetly given out by the music box while the water current is lively circulated in and out of the water pump.

DETAILED DESCRIPTION OF THE PREFERRED EMBODIMENT

Figure 1:
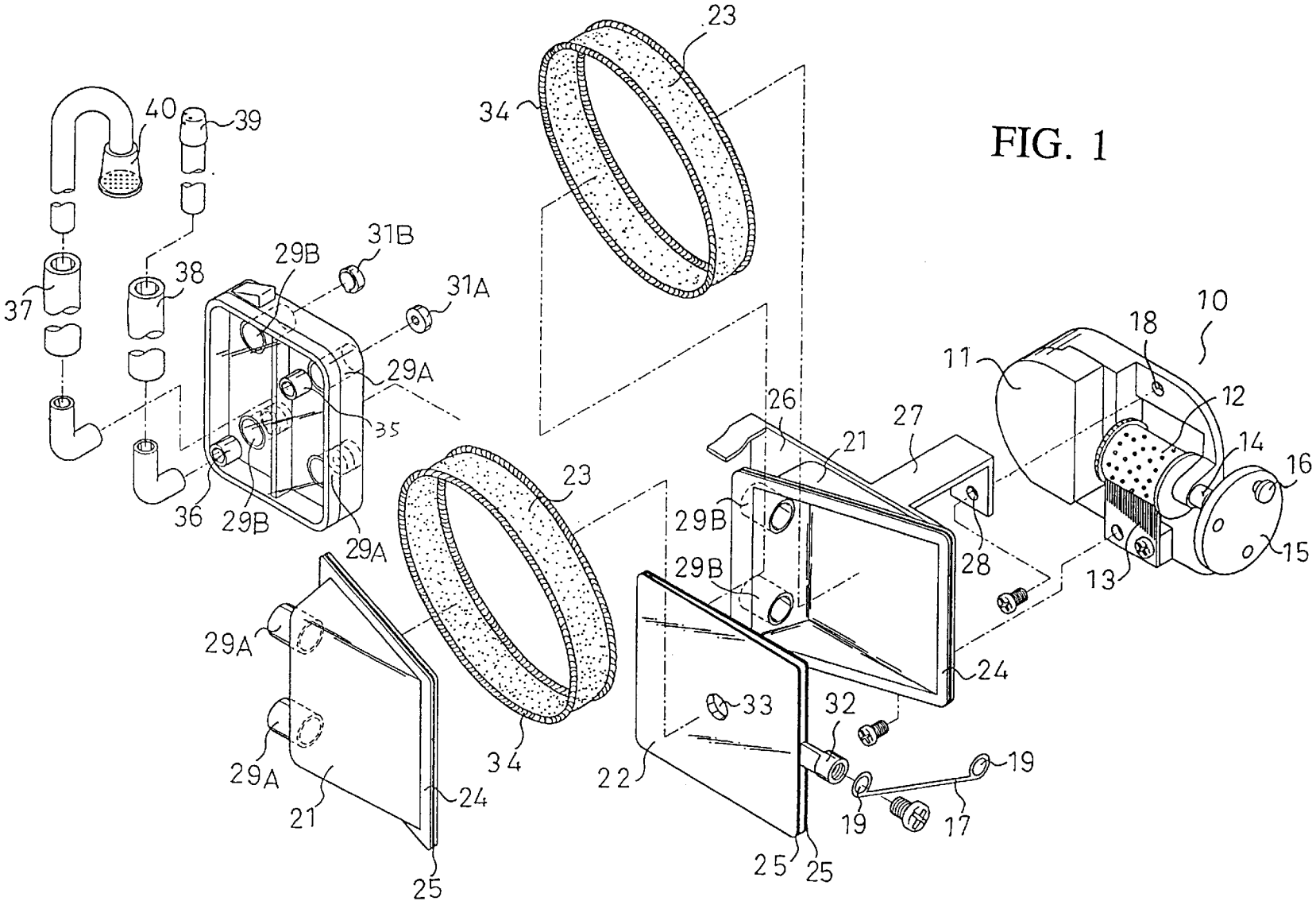
FIG. 1 is an exploded view of the present invention.
Figure 2:
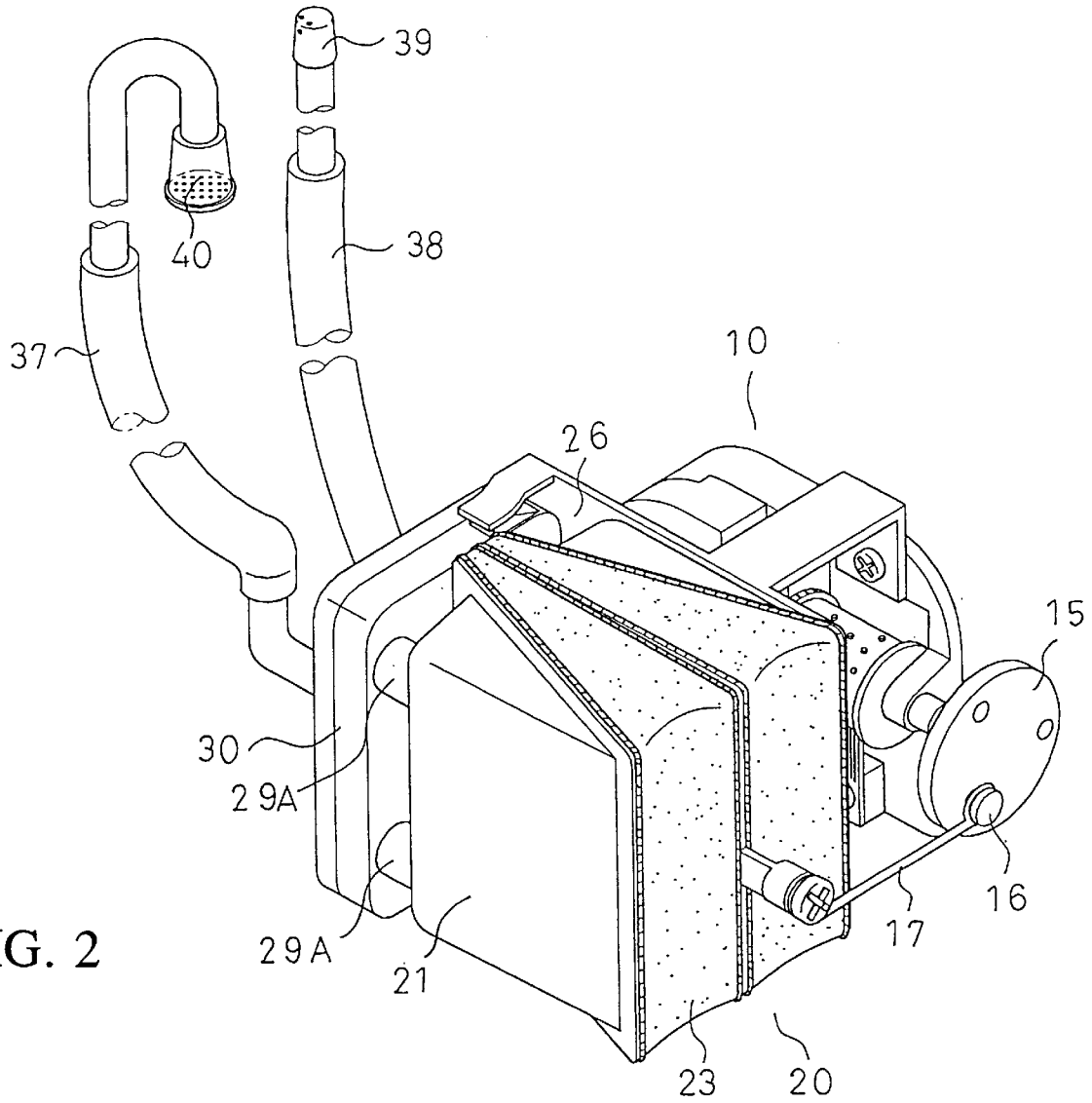
FIG. 2 is an assembled view of the present invention.

Please refer to FIGS. 1, 2, and 3. The present invention relates to a music box having a water pump structure, especially to a music box 10 in combination with a water pump 20. The music box 10 is mainly made up of a main spring seat 11, a rolling wheel 12, and a comb-shaped resilient plate 13, wherein the rolling wheel 12 is provided with protruding dots by which the comb-shaped resilient plate 13 is triggered to give out music. And, the music box 10 has a through hole 18 by which the water pump 20 is engaged with the music box 10. Besides, a rotary disc 15 is connected to one lateral side of the rolling wheel 12 via a rotary shaft 14. The outer surface of the rotary disc 15 has a connecting column 16 to which a linking member 17 is engaged at one end. The other end of the linking member 17 is joined to the water pump 20. In this way, the movement triggered off by the main spring seat 11 and the comb-shaped resilient plate 13 will provide the necessary driving force for the mechanism of the water pump 20 thereof.

The water pump 20 includes main bodies 21, a water pressure plate 22, and rubber membranes 23. The main bodies 21 are partitioned in the middle by the water pressure plate 22 into two corresponding sectionally triangular U-shaped casings. Each main body 21 is provided with protruding flanges 24 at the four base edges defining an engaging groove 25 therebetween. One of the main bodies 21 is engaged with a base 26 which having a connecting member 27 and a through hole 28 disposed thereon can engage the water pump 20 with the music box 10 thereof at through hole 18. Besides, both main bodies 21 are provided with two tubes at the upper part respectively, one having the water influx tubes 29A, the other having the water discharging tubes 29B, and the four tubes of which are all connected to a regulating valve 30.

The water pressure plate 22 is a rectangular plate having two parallel grooves 25 defining the four base edges, whereby a screw seat 32 is disposed at the middle section of one base edge. Besides, a circular through hole 33 is disposed at the center of the water pressure plate 22.

The rubber membranes 23 are two collar-shaped members, each having ring flanges 34 circling the two lateral edges thereof by which the rubber membrane 23 is engaged to the groove 25 of the main body 21 and that of the water pressure plate 22 so as to circumscribe an enclosed space for water to be circulated therein.

A regulating valve 30 is disposed at the rear of the main bodies 21, having a water influx hole 35 and a water discharging hole 36 disposed at one lateral side to be engaged with a water influx pipe 37 and a water discharging pipe 36 respectively. In addition, two one-dimensional water influx valves 31A and two one-dimensional water discharging valves 31B are disposed at the other lateral side of the regulating valve 30 to be stopped at the water influx tubes 29A and the water discharging tubes 29B of the main bodies 20 respectively. By means of the one-dimensional water influx and discharging valves 31A, 31B, the regulating valve 30 can control the circulation of water in one direction to prevent water from flowing conversely. The outlet of the water discharging pipe 38 has a spout 39 for the water to come out easily, while that of the water influx pipe 37 is provided with a filter 40 having through holes disposed thereon so as to avoid ornamental objects from flowing into the water pump 20.

Figure 3B:
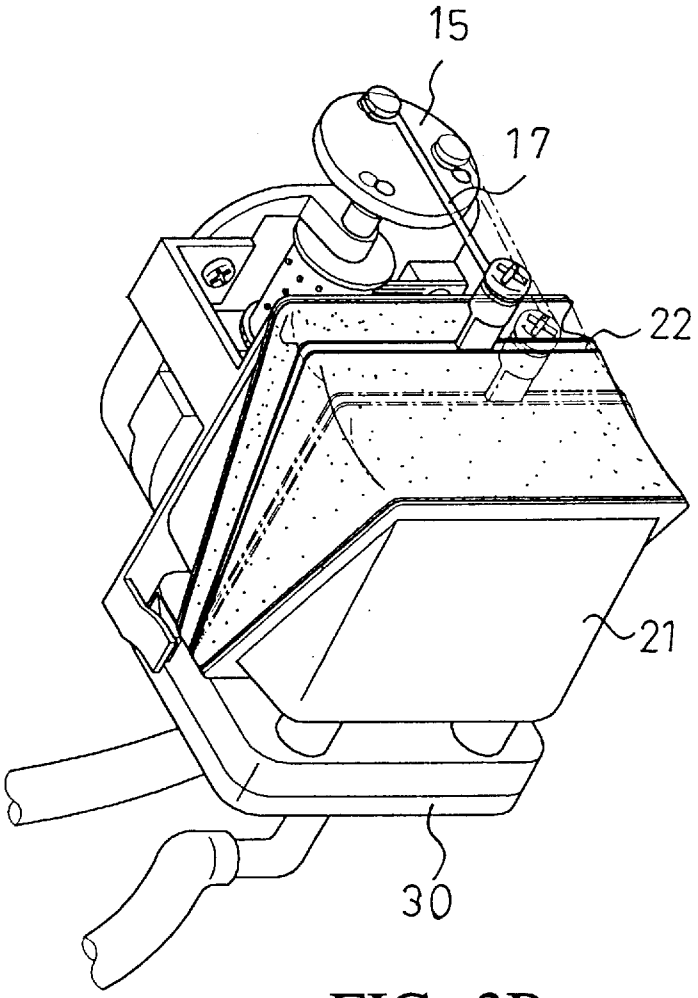
FIGS. 3A–3B are diagrams showing the movement of the linking member, triggering off the mechanism of the present invention.
Figure 3A:
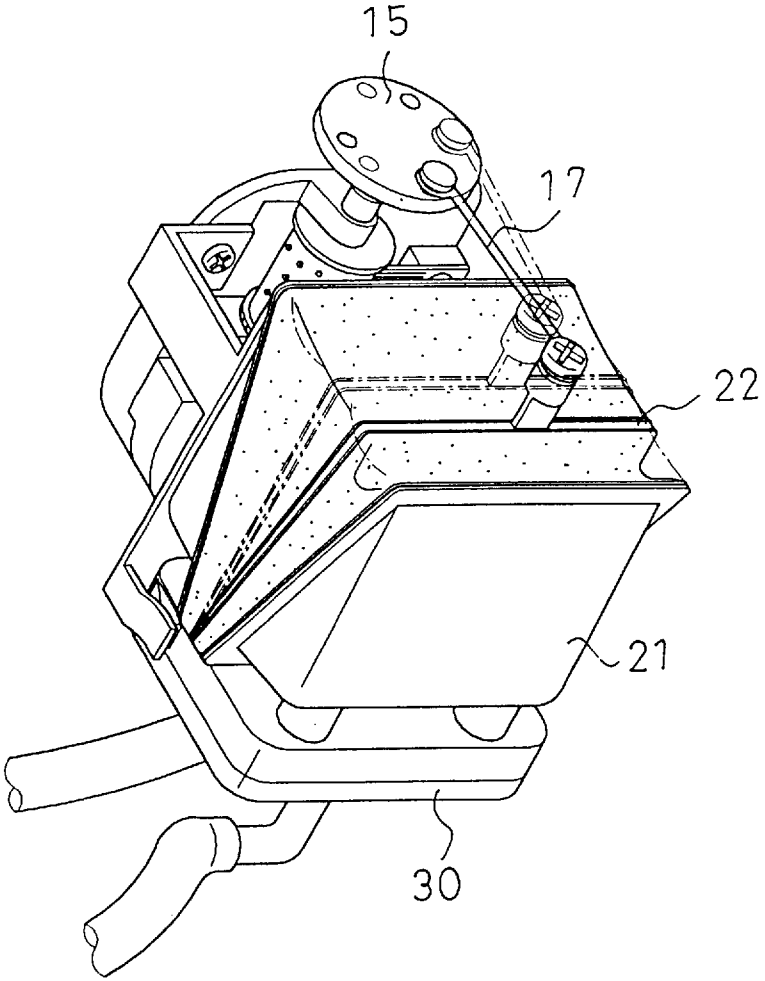

Please refer to FIG. 2. In assembly, the ring flanges 34 of the rubber membranes 23 are engaged with the grooves 25 of the main bodies 21 and the water pressure plate 22 respectively, opens the main bodies 21 and the water pressure plate 22 into a whole set. The water influx tubes 29A and water discharging tubes 29B are then connected to one side of the regulating valve 30 respectively, each of them stopped with a one-dimensional water influx valve 31A or a one-dimensional water discharging valve 31B as proper. Furthermore, the water pump 20 is connected to the music box 10 via a bolt screwed up in the through hole 28 disposed at the connecting member 27 of the base 26 and into the through hole 18 of the music box 10. Finally, one sleeve end 19 of the linking member 17 is engaged with the screw seat 32 of the water pressure plate 22 via a screw. Thus, by means of the linking member 17 attached by both sleeve ends 19 to the music box 10 and the water pump 20 respectively, the rotation of the rotary disc 15 of the music box 10 will activate the water pressure plate 22 to move back and forth as shown in FIGS. 3A–3B. And the to-and-fro movement of the water pressure plate 22 will in turn generate a pressure within the main bodies 21 and force water current to circulate in and out of the water current pump 20.

Figure 4:
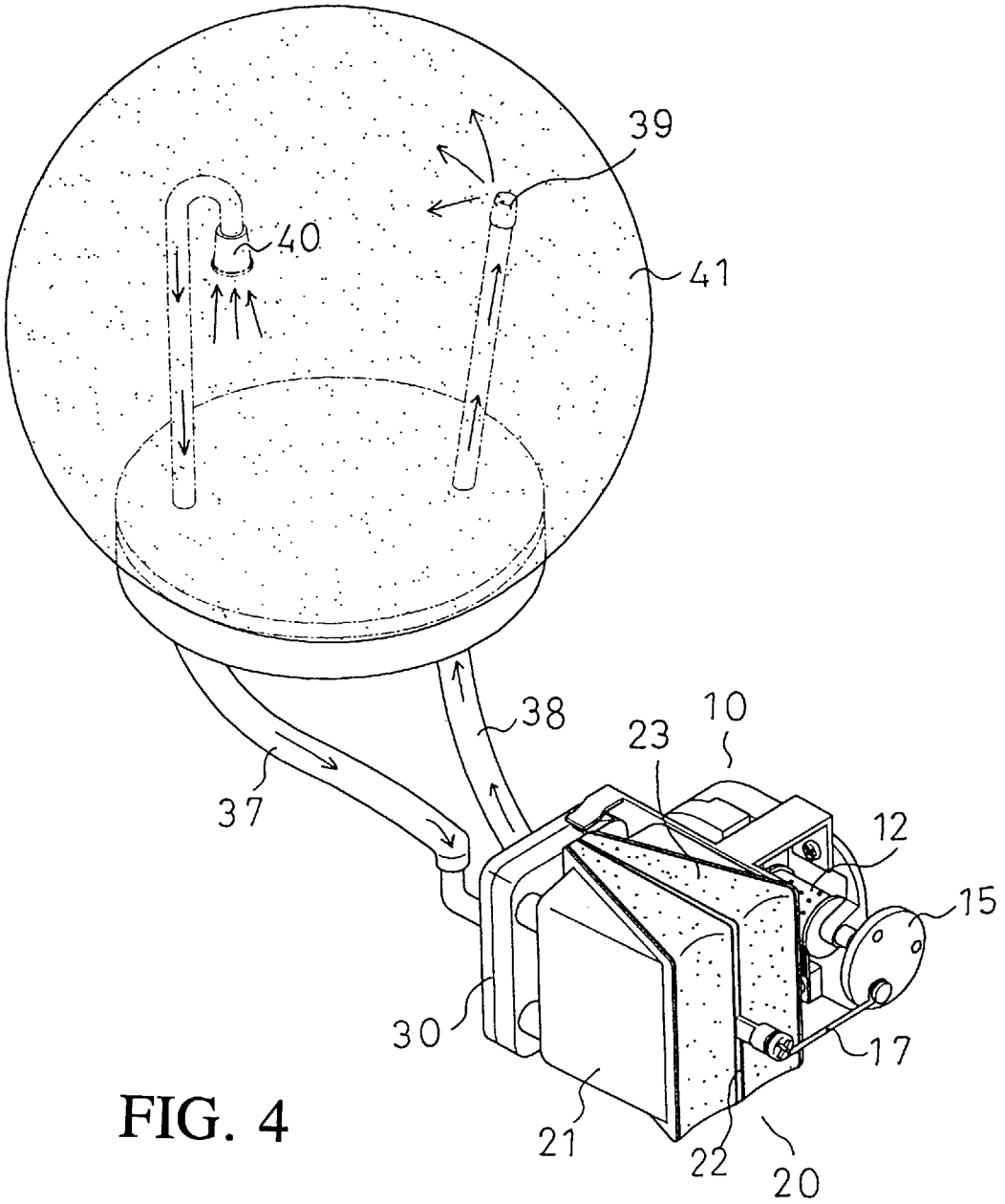
FIG. 4 is a practical embodiment of the present invention in combination with a crystal ball.

Please refer to FIG. 4. The present invention works by link mechanism. The force of motion generated by the rolling wheel 12 and the resilient plate 13 of the music box 10 will motivate the rotation of the rotary disc 15 which in turn will trigger off the movement of the linking member 17. The linking member 17 then activates the to-and-fro motion of the water pressure plate 22. And by means of the pressure generated by the activated water pressure plate 22, water currents in the enclosed space of the main bodies and the rubber membranes is forced to circulate between the two separate main bodies through the communication of the circular through hole 33 disposed at the center of the water pressure plate 22 thereof In addition, by means of the regulating valve 30, the water will circulate properly in one direction in and out of the water pump 20. The water fed in by the water influx pipe 37 into the regulating valve 30 through the water influx hole 35 thereof will flow into the water pump 20 through the water influx tubes 29A via the one-dimensional water influx valves 31A. Conversely, via the one-dimensional water discharging valves 31B, water will be discharged out of the water pump 20 through the water discharging. tubes 29B and then out of the regulating valve 30 by the water discharging pipe 38 connected with the water discharging hole 36 of the regulating valve 30. The water influx pipe 37 is further provided with a filter 40 disposed with through holes thereon at the outlet and the water discharging pipe 38 with a spout 39 likewise. The filter 40 and the spout 39 are then adapted to a crystal ball 41 as shown in FIG. 4 wherein the crystal ball 41 is dispersed with artificial ribbon dust or snowflakes. The filter 40 will prevent the ornamental objects from being fed into the water influx pipe 37, while the spout 39 will discharge water out of the water discharging pipe 38, generating a moving current within the crystal ball 41 to create various lively shapes and figures out of the dispersed ornamental objects.

In addition to the crystal ball 41, the present invention can also be employed in combination with other ornamental devices or decoration. Thus, there are several advantages inherent in such music box having water pump structure:

1. No electricity is required for the motion of the present invention. There is therefore no problems concerning the leakage of electricity and the location of displaying the device.
2. The practical value of a conventional music box is boosted by being combined with a water pump.
3. By the mechanism triggered off by the linking member connecting the music box and the water pump, music is sweetly given out while water is lively circulated at the same time.
4. When the water pressure plate is moved back and forth, the U-shaped triangular casings of the main bodies can generate big force so as to increase the frequency of discharging water out of the spout.
5. In addition to a crystal ball, the attachments to the present invention can be varied to include other ornamental articles such as a doll so as to boost up the practical value of the present invention.

What is claimed is:

1. A combination music box and water pump comprising;

a music box, a water pump, and a regulating valve, the music box being engaged to the water pump and the regulating valve being engaged to a rear side of the water pump, the music box having a rotary disc with a connecting column thereon, a linking member rotatably attached to said connecting column at a first end and to a water pressure plate of the water pump at a second end, the regulating valve controlling a direction of water respectively through water influx tubes and water discharge tubes into and out of the water pump, wherein the water pump comprises two casings, the water pressure plate having a hole therethrough and two rubber membranes, a groove formed around an outer periphery of each of the two casings, a pair of grooves formed around an outer periphery of the water pressure plate, a pair of flanges engaged around two peripheries of each of the two rubber membranes, a first flange of said pair of flanges of each of the two rubber membranes respectively engaged in the groove formed around the outer periphery of the two casings and a second flange of said pair of flanges of each of the two rubber membranes respectively engaged in the pair of grooves formed around the outer periphery of the water pressure plate to form an enclosed space between each of the two casings and the water pressure plate, wherein when the music box is playing, the rotary disc is rotated and moves the linking member and the water pressure plate back and forth to pump water in and out of the water pump into ornamental articles communicating with the water pump.

2. The combination as claimed in claim 1, wherein the regulating valve is attached to the rear of the water pump by the water influx tubes and water discharge tubes engaged to the water pump, the regulating valve having a water influx hole and a water discharge hole respectively engaged to a water influx pipe and a water discharge pipe, the regulating valve further having two one-dimensional water influx valves and two one-dimensional water discharge valves in the water influx tubes and the water discharge tubes engaged to the two casings so as to regulate water in and out of water pump in one direction.

3. The combination as claim in claim 2 wherein the water influx pipe is engaged to a filter having through holes disposed thereon and the discharge pipe has a spout, the filter serving to keep ornamental objects in the ornamental articles from entering the water influx pipe and the spout facilitating the discharge of water out of the water discharge pipe.

* * * * *